US006402473B1

(12) United States Patent
Chapman

(10) Patent No.: US 6,402,473 B1
(45) Date of Patent: Jun. 11, 2002

(54) CENTRIFUGAL IMPELLER WITH HIGH BLADE CAMBER

(75) Inventor: Thomas R. Chapman, Templeton, MA (US)

(73) Assignee: Robert Bosch Corporation, MA (US)

( * ) Notice: Subject to any disclaimer, the term of this patent is extended or adjusted under 35 U.S.C. 154(b) by 0 days.

(21) Appl. No.: 09/618,073

(22) Filed: Jul. 17, 2000

Related U.S. Application Data

(60) Provisional application No. 60/177,942, filed on Jan. 25, 2000, and provisional application No. 60/144,401, filed on Jul. 16, 1999.

(51) Int. Cl.[7] ..... F03B 3/12
(52) U.S. Cl. ..... 416/178; 416/DIG. 2
(58) Field of Search ..... 416/243, DIG. 2, 416/DIG. 5, 186 R, 178

(56) References Cited

U.S. PATENT DOCUMENTS

| | | | | |
|---|---|---|---|---|
| 4,401,410 A | | 8/1983 | Nishikawa | 416/186 |
| 5,199,846 A | * | 4/1993 | Fukasaku et al. | 415/119 |
| 5,478,201 A | | 12/1995 | Amr | 415/206 |
| 5,586,053 A | * | 12/1996 | Park | 364/512 |

FOREIGN PATENT DOCUMENTS

| | | | |
|---|---|---|---|
| DE | 338436 | 8/1920 | |
| DE | 1703120 | 8/1971 | F04D/29/66 |
| GB | A 941343 | 11/1963 | |

OTHER PUBLICATIONS

PCT International Search Report, Date of Mailing Nov. 20, 2000, International Application No. PCT/US00/19428.

* cited by examiner

*Primary Examiner*—Edward K. Look
*Assistant Examiner*—Richard A. Edgar
(74) *Attorney, Agent, or Firm*—Fish & Richardson P.C.

(57) ABSTRACT

A centrifugal impeller with high blade camber exhibits relatively high non-dimensional pressure and flow performance while maintaining a high operating efficiency. This invention suits itself towards applications where high operating efficiency is required in a relatively small package space or where low noise and vibration are required. The impeller blades are characterized by: a) a high positive camber at a radially inward region of the blade, for example, a maximum camber value of at least 7% of the blade chord, which occurs at x/C<0.4; and b) a large trailing edge angle, for example, a trailing edge that forms an angle of at least 70 degrees with the impeller tangent. The ratio of blade chord to impeller diameter is at least 0.15.

15 Claims, 3 Drawing Sheets

CENTRIFUGAL IMPELLER WITH HIGH BLADE CAMBER

This application claims priority from provisional applications Ser. No. 60/177,942, filed Jan. 25, 2000 and No. 60/144,401, filed Jul. 16, 1999.

BACKGROUND OF THE INVENTION

This invention relates to centrifugal blowers, such as those used for heating, ventilating, and air conditioning (HVAC).

A basic design feature of a centrifugal impeller is the angle that the blade trailing edge makes with a tangent to the impeller. This angle is called the blade trailing edge angle. Backward curved impellers have blade trailing edge angles less than 90 degrees, while forward curved impellers have blade trailing edge angles in excess of 90 degrees. Another basic design feature is the blade camber. Blade camber is defined as the ratio of the perpendicular distance from the meanline to the blade chord, to the length of the blade chord itself.

Two important performance characteristics of a centrifugal impeller are its non-dimensional flow and pressure capability; i.e., the performance capability of the impeller normalized on diameter and operating speed. Backward curved impellers typically run faster or are larger in diameter than a forward curved impeller running at the same operating point, and backward curved impellers typically operate at higher static efficiencies. Forward curved impellers operate at lower efficiencies, but can either run more slowly or be smaller in diameter at the same operating point.

In automotive climate control applications for centrifugal blowers, the impeller may be located within the cabin adjacent to the occupants, so that noise and vibration control are important. In these and various other applications, centrifugal blowers should operate not only with low noise and vibration, but they also should operate with high efficiency over a span of operating conditions in a relatively small volume package. For example, in automotive HVAC systems, several functions may be achieved by opening and closing duct passages, and flow resistance typically is greatest in heater and defrost conditions and least in air conditioning mode. Impeller output should be strong in all operating conditions, if at all possible, and impeller operation should be quiet at all operating points. With respect to backward curved impellers in particular, high resistance heater and defrost modes may cause particular noise problems, which may be termed a low frequency roar.

Yapp, U.S. Pat. No. 4,900,228 discloses rearwardly curved centrifugal impeller blades with "S" shaped camber. One embodiment discloses a maximum camber which is 5% of blade chord, and a blade exit angle between 50 and 60 degrees from the impeller tangent.

SUMMARY OF THE INVENTION

This invention combines characteristics of both backward curved and forward curved impellers to gain the advantages of both. The leading edge geometry is similar to that of a conventional backward curved impeller, but the camber and trailing edge angles are much higher.

In general, one aspect of the invention features a centrifugal impeller whose radially extending blades are characterized by:

a) a high positive camber at a radially inward region of the blade, for example, a maximum camber value of at least 7% and even 10% or more of the blade chord, and the maximum camber occurs at $x/C<0.5$, and preferably at $x/C<0.4$;

b) a large trailing edge angle, for example, a trailing edge that forms an angle of at least 70 degrees with the impeller tangent; and c) a top shroud surface, which is shaped—i.e., it has curvature in a plane that contains the impeller axis (the "radial direction", FIG. 3)—to help control flow diffusion and help eliminate stall, and which is connected to the impeller blades and covers at least a substantial portion of the chord length of the impeller blades. The shroud can also sometimes incorporate an inlet lip to help the flow enter the impeller blades with relatively low turbulence, helping reduce the possibility of stall.

In preferred embodiments, the chord is long, typically at least 15% or even 20% of the impeller diameter. Also in preferred embodiments, the impeller has a cylindrical area ratio between 1.0 and 1.5 , the blade leading edge radius is at least 0.8% of the blade chord length, and at least one impeller component is injection molded plastic. The impeller diameter is between 75 and 300 millimeters, and the ratio of blade number to impeller diameter in millimeters is at least 0.15 and is more preferably at least 0.2.

The invention controls not only low frequency roar, but also overall noise and vibration under given operating conditions. The blade leading edges are aligned with the incoming airflow to limit the aerodynamic loading there, preventing immediate flow separation. The blades are highly cambered and have a relatively high blade trailing edge angle, enabling the impeller to have high non-dimensional flow and pressure capability. The blade trailing edge angle approaches that of a conventional forward curved impeller, but the design of the hub, the curved shroud surfaces and greater blade chord length allow diffusion (the conversion of kinetic energy into static pressure) to occur. A high blade number also helps to control the diffusion process. The invention is particularly suitable for automotive applications because it can provide performance similar to conventional backward curved impellers, but at a lower operating speed or smaller diameter.

Other features and advantages of the invention will be apparent to those skilled in the art from the following description of the preferred embodiment and from the claims.

DESCRIPTION OF THE PREFERRED EMBODIMENTS

Figure 1:
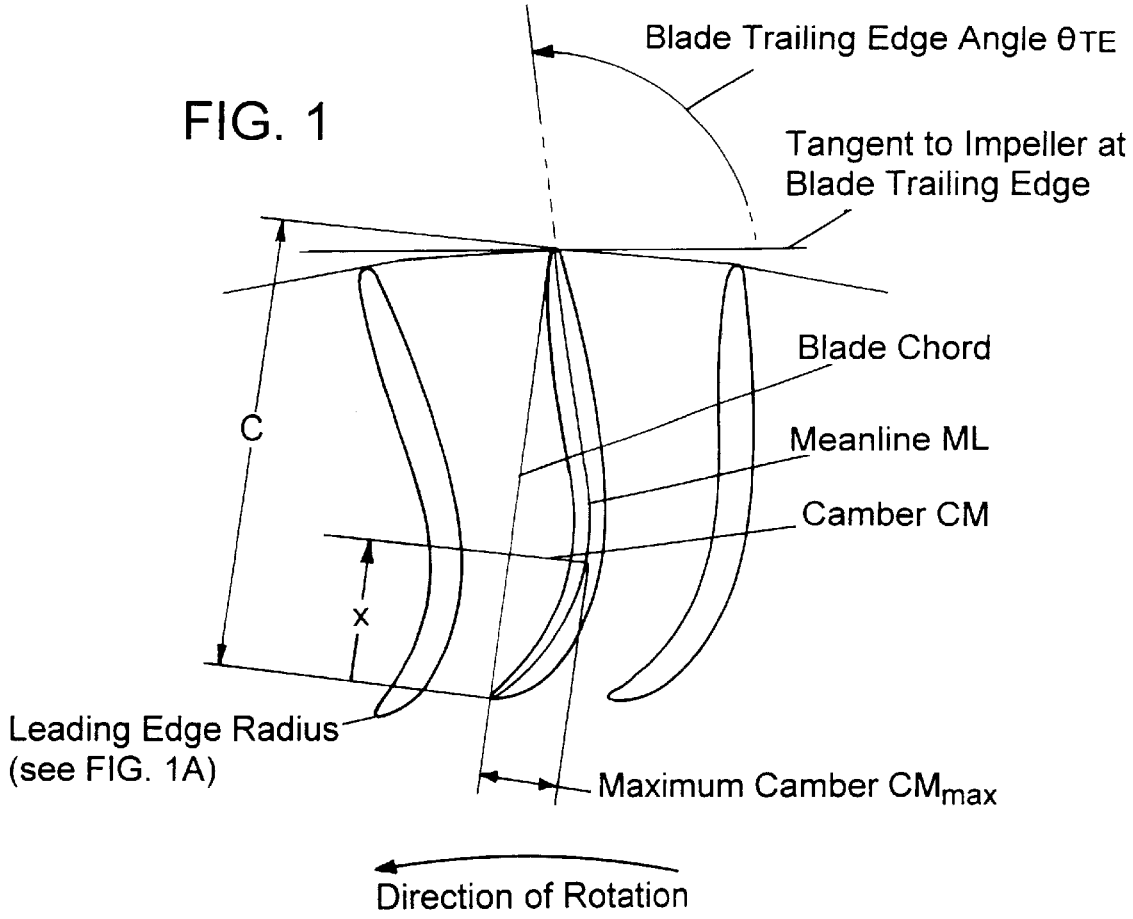
FIG. 1 is a cross sectional view of the impeller blades showing the blade chord, meanline, maximum camber, and blade trailing edge angle.

FIG. 1 is a cross sectional representation of the blades of the invention, showing their shape. As noted, the trailing edge angle TE is the angle that the blade trailing edge makes with a tangent to the impeller. In preferred embodiments, the impeller blades are two-dimensional, i.e.; the meanline (ML) does not change in the direction of the blade span. The camber CM is the perpendicular distance between the meanline ML and blade chord C, and the maximum value of camber ($CM_{max}$) is positioned toward the leading edge at a point x positioned along the chord close enough to the leading edge to avoid stall. In FIG. 1, $CM_{max}$ is positioned at x about x/C=0.32 (where C is the entire chord). In any event, the desired relationship is x/C<about 0.4 or 0.5.

The blade leading edges are aligned with the incoming airflow to limit the aerodynamic loading there, preventing immediate flow separation. The maximum blade camber preferably is between 10 and 35% of the blade chord ($0.10C<CM_{max}<0.35C$), but that range can be extended to $0.07C<CM_{max}<0.35C$. Stall is very difficult to control with a maximum blade camber over 35% of the blade chord.

Without wishing to be bound to a specific theory explaining the invention, the following explanation is offered. At high flow resistance conditions, such as the automotive HVAC heating and defrost modes, a centrifugal impeller is susceptible to stall. Stall is a condition where the impeller abruptly loses a significant portion of its performance capability and generates a substantial amount of noise, characterized by a low frequency rumble or roar. This loss of performance may be due to the separation of the boundary layer flow from the impeller blades. The attached boundary layer flow allows the diffusion process to take place, increasing the operating efficiency of the impeller. Premature boundary layer separation leads to reduced performance since the diffusion process breaks down when the boundary layer separates from the impeller blades.

The invention is designed so that the impeller blades diffuse the flow near the leading edge, where the boundary layer energy is high. Flow diffusion is much reduced towards the trailing edge, where a lower energy, thick boundary layer is susceptible to separation.

The goal of this impeller design is to prevent the onset of stall at the high flow resistance conditions, and also to incorporate high blade trailing edge angles. The high blade trailing edge angles allow for high flow exit velocities at a relatively low impeller rotation rate. The low rotation rate (for a given diameter) enables lower noise and vibration characteristics.

Figure 1A:
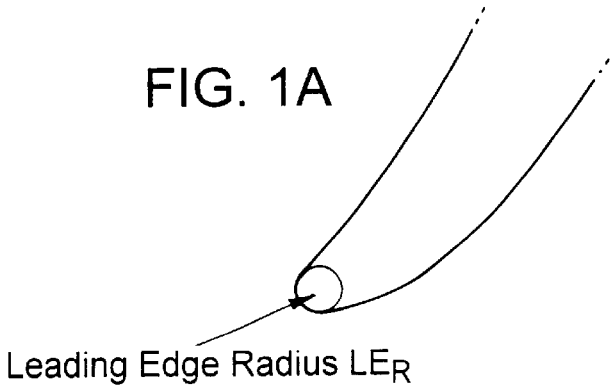
FIG. 1*a* is a close-up view showing the blade leading edge radius.

In preferred embodiments, a relatively blunt leading edge radius LER of at least 0.8% of blade chord C (FIG. 1A) is also used to reduce noise generation and tonal noise content. The maximum leading edge radius is limited by molding, blade spacing, and airflow characteristics.

Figure 2:
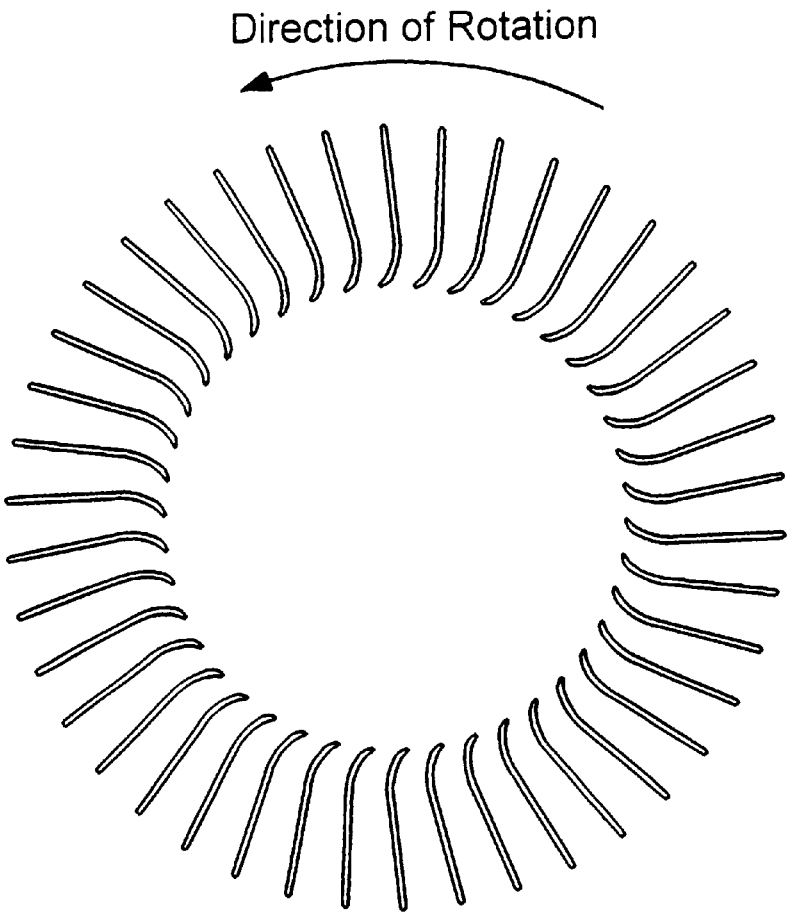
FIG. 2 is a cross sectional view of the impeller, showing the blades and rotation direction of the impeller.

Ordinarily, impeller blades with extreme camber, such as those characteristic of the invention, would induce immediate stall. The high blade number and large blade chord length (compared to typical backward curved impellers), as well as the design of the hub and the curved shroud surfaces mitigate this problem, however. The high blade number (FIG. 2) reduces the amount of work that each blade must perform, helping to increase the stall resistance of the impeller. In some embodiments, there will be at least 40 blades, each of which is identical.

The surfaces of the adjacent blades and the surfaces of the hub and shroud define a blade passage cross sectional area. The high blade number limits the increase in the blade passage cross-sectional area, and thus limits diffusion, since more blades occupy a higher fraction of the available space. In preferred embodiments, the ratio of blade number to impeller diameter in millimeters is at least 0.2, but it can be as low as 0.15. The maximum number of blades is constrained by molding, blade spacing and airflow characteristics.

The large blade chord allows more opportunity for pressure recovery to take place, distributing the amount of work over a longer blade. The maximum blade chord is limited by blade number, and by the minimum required size of the air inlet; as the air inlet becomes smaller, losses associated with accelerating the air thorough the inlet increase. The minimum blade chord is limited by the stall performance of the impeller. The chord is long, typically at least 15% or even 20% of the impeller diameter.

Figure 3:
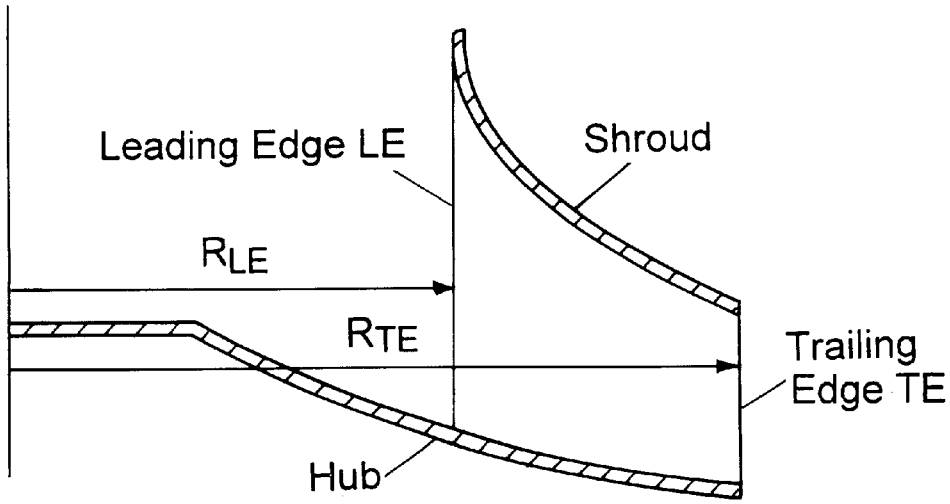
FIG. 3 is a cross sectional view of the impeller, showing the hub and shroud shapes, with adjacent blades omitted for clarity.
Figure 4:
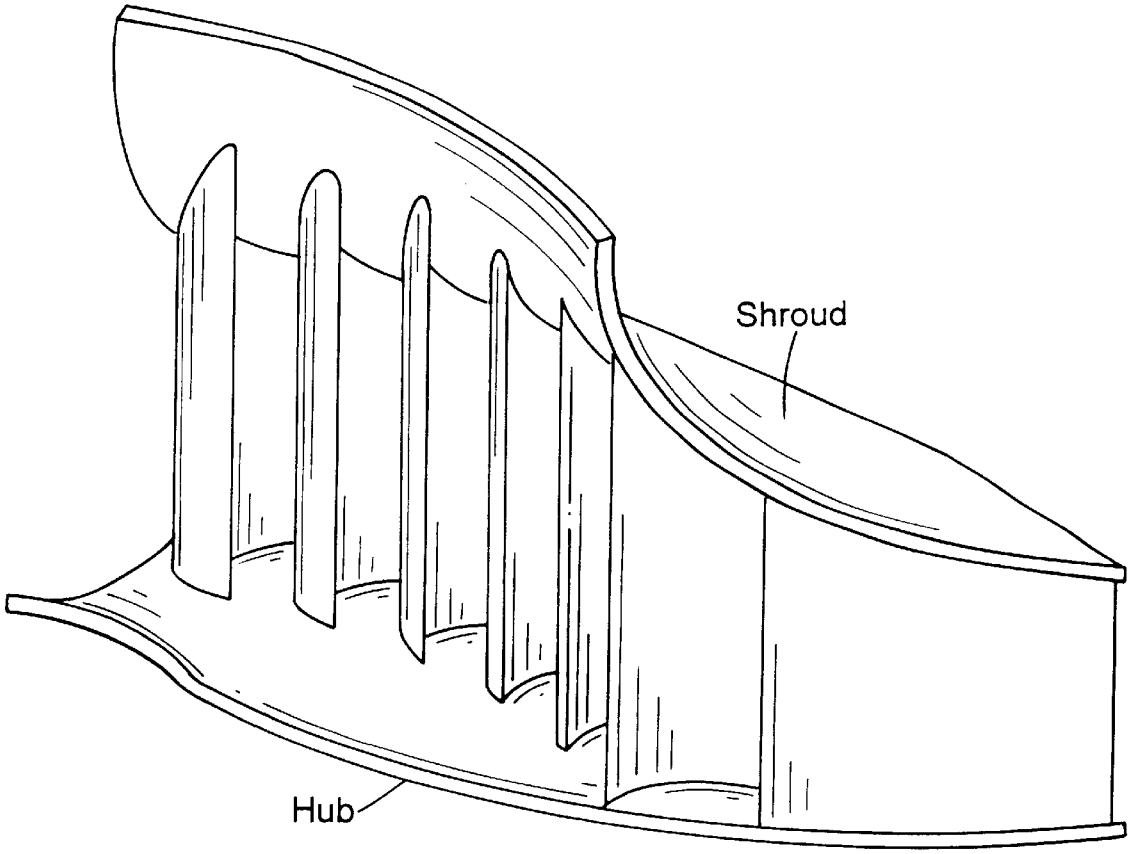
FIG. 4 is a perspective view of the impeller showing the shape of the blades and the shroud.

The hub and shroud (FIGS. 3 and 4) are also configured to limit the increase, as well as the rate of increase, in blade passage cross sectional area. This results in a controlled diffusion process through the blade passages. The hub and curved shroud design may also help keep the boundary layer separation point stable, preventing the separation point from shifting position or propagating upstream. The shroud is connected to the blades along a substantial portion of the chord length, i.e., enough of the chord length to significantly eliminate stall in the operating range. Typically, the shroud is connected along at least 75% of the chord length, and preferably along 90 to 100% of the chord length, making allowance for molding considerations at the leading edge.

The radial position of the blade leading edges and the span of the blades at the leading edge define a cylinder of radius RLE. The radial position of the blade trailing edges and the span of the blades at the trailing edge define another cylinder of radius RTE. The height of each of the cylinders is determined by the length of the leading edges (LE) and trailing edges (TE) shown in FIG. 3. The ratio between the cross-sectional area defined by the first cylinder ($2\pi RLE*LE$) to that defined by the second cylinder ($2\pi RTE*TE$) is called the cylindrical area ratio. The cylindrical area ratio must be large enough to control stall, but not so large as to compromise package volume. In preferred embodiments, the cylindrical area ratio is between 1.0 and 1.5.

Other embodiments are within the following claims.

What is claimed is:

1. A centrifugal impeller mounted to rotate on an axis, said impeller comprising a plurality of radially extending blades, said impeller being characterized by a cylindrical area ratio between 1.0 and 1.5, said blades being characterized by:

a) a high positive camber at a radially inward region of the blade, said positive camber having a maximum value of at least 10% of the blade chord and said maximum value occurring at x/C<0.5;

b) a large trailing edge angle of at least 70 degrees but less than 135 degrees with respect to the impeller tangent; and c) a top shroud surface connected to the impeller blades, covering at least a substantial portion of the chord length of the impeller blades.

2. A centrifugal impeller mounted to rotate on an axis, said impeller comprising a plurality of radially extending blades, said impeller being characterized by a cylindrical area ratio between 1.0 and 1.5, said blades being characterized by:

a) a high positive camber at a radially inward region of the blade, said positive camber having a maximum value of at least 7% of the blade chord and said maximum value occurring at x/C<0.5;

b) a large trailing edge angle of at least 70 degrees but less than 135 degrees with respect to the impeller tangent; and c) a top shroud surface connected to the impeller blades, covering at least a substantial portion of the chord length of the impeller blades.

3. The centrifugal impeller of claim 1 or claim 2 with the maximum value of the blade camber occurring at $x/C<0.4$.

4. The centrifugal impeller of claim 1 or claim 2 further comprising a top shroud surface that has curvature in a plane that contains the impeller axis.

5. The centrifugal impeller of claim 1 or claim 2 in which the blade chord is at least 15% of the impeller diameter.

6. The centrifugal impeller of claim 1 or claim 2 in which the blade leading edge radius is at least 0.8% of the blade chord length.

7. The centrifugal impeller of claim 1 or claim 2 in which the blade number to diameter ratio is at least 0.15 where the diameter is measured in millimeters.

8. The centrifugal impeller of claim 1 or claim 2 in which the blade number to diameter ratio is at least 0.2 where the diameter is measured in millimeters.

9. The centrifugal impeller of claim 1 or claim 2 comprising at least one injection molded plastic component.

10. The centrifugal impeller of claim 1, claim 2 or claim 9 in which the impeller diameter is between 75 and 300 millimeters.

11. The centrifugal impeller of claim 1 or claim 2 where said positive camber has a maximum value no more than 35% of the blade chord.

12. The centrifugal impeller of claim 1 or claim 2 in which the top shroud covers at least 75% of the chord length of the impeller blades.

13. The centrifugal impeller of claim 1 or claim 2 in which the top shroud covers at least 90% of the chord length of the impeller blades.

14. The centrifugal impeller of claim 1 or claim 2 in which the blade chord is at least 20% of the impeller diameter.

15. The centrifugal impeller of claim 2 further comprising a top shroud surface that has curvature in a plane that contains the impeller axis, said blades being further characterized by a blade chord is at least 15% of the impeller diameter, said impeller comprising at least one injection molded plastic component, the impeller diameter being between 75 and 300 millimeters, said positive camber having a maximum value no more than 35% of the blade chord, and the top shroud covering at least 75% of the chord length of the impeller blades.

* * * * *